United States Patent [19]

Cleveland et al.

[11] Patent Number: 5,040,675

[45] Date of Patent: Aug. 20, 1991

[54] GOLF BALL ACCESSORY

[76] Inventors: Randy E. Cleveland, 1130 Century Park, Garland, Tex. 75040; Barton L. Owen, 10825 St. Michaels, Dallas, Tex. 75230

[21] Appl. No.: 525,676

[22] Filed: May 21, 1990

[51] Int. Cl.[5] ..... B65D 85/00; A47F 7/00

[52] U.S. Cl. ..... 206/315.9; 206/815; 211/15; 221/307

[58] Field of Search ..... 206/315.9, 815; 211/14, 211/15; 221/303, 305, 307, 309; 312/49, 71; 224/196, 918, 919; 273/32 D

[56] References Cited

U.S. PATENT DOCUMENTS

| | | | |
|---|---|---|---|
| 1,778,225 | 10/1930 | Morss | 206/315.9 |
| 2,570,504 | 10/1951 | Van House | 280/53 |
| 2,590,154 | 3/1952 | Burns | 280/47.19 |
| 2,662,776 | 12/1953 | Hurst | 280/47.19 |
| 2,771,988 | 11/1956 | Sweeney | 206/815 X |
| 2,806,711 | 9/1957 | Jacobs | 280/47.19 |
| 2,881,925 | 4/1959 | Idoux | D34/15 |
| 2,883,207 | 4/1959 | Reich | 280/47.19 |
| 2,950.748 | 8/1960 | Olinghouse | 206/315.9 X |
| 3,164,393 | 1/1965 | Upham | 280/47.19 |
| 3,206,067 | 9/1965 | Smith, Jr. et al. | 221/309 |
| 3,412,897 | 11/1968 | Slater | 221/309 |
| 4,082,209 | 4/1978 | Sander | 221/309 X |
| 4,106,678 | 8/1978 | Thomas | 221/309 X |
| 4,299,345 | 11/1981 | Lanzl | 221/309 X |
| 4,610,373 | 9/1986 | Sherbondy | 221/303 X |
| 4,798,319 | 1/1989 | James, Jr. | 224/196 X |
| 4,832,362 | 5/1989 | Chen | 280/645 |
| 4,852,896 | 8/1989 | Mills | 280/47.18 |
| 4,927,052 | 5/1990 | Marthaler et al. | 221/307 X |

FOREIGN PATENT DOCUMENTS

| | | | |
|---|---|---|---|
| 457154 | 11/1936 | United Kingdom | 211/14 |

*Primary Examiner*—Bryon P. Gehman

*Attorney, Agent, or Firm*—Mark Lee Hogge

[57] ABSTRACT

A golf accessory for dispensing golf balls and tees is constructed of a hollow preferably transparent tube of about 44" in length. Golf balls are maintained in the tube and are biased by a spring which extends from the top to the bottom of the hollow space within the tube when the tube is empty. Ingress and egress of golf balls occur towards the top of the tube on the sides where there is provided an expandable opening with an opposed opening, which may also be expandable, to urge golf balls into and out of the hollow of the tube. The hollow tube may hold up to a dozen golf balls. The top of the tube provides a container for tees, being outfitted with a removable plastic cap. The golfing accessory is to be used with and inserted into a typical golf bag much in the same fashion that a golf club is inserted and removed from the golf bag.

16 Claims, 1 Drawing Sheet

GOLF BALL ACCESSORY

BACKGROUND OF THE INVENTION

1. Field of the Invention

The invention relates to the game of golf and the equipment used by golfers. More in particular, the present invention relates to a golf ball and golf tee dispenser for use with or without common golf bags.

2. Background Information

The inventors are aficionados and students of the game of golf. There is a variation to the game of golf known as playing a "Mulligan". Thus, when players tee off rather badly, they have the option of declaring a "Mulligan". Whereupon, the player declaring a "Mulligan" may obtain another golf ball from his bag, tee it up and attempt to drive again. "Mulligan" is an agreed upon forgiveance and no stroke is incurred. A problem arises, however, when many "Mulligans" are declared. Easy access to many golf balls becomes imperative. Thus, there is a need in the art for a readily accessible golf ball and tee dispensing apparatus.

Golf ball dispensers are not unknown. Attempts have been made in the art to develop a golf ball dispenser in combination with a golf bag; the prior art suffers from complexity or inoperability.

U.S. Pat. No. 2,806,711 to Jacobs discloses a golf cart in FIG. 3 which has a spring loaded golf ball dispenser in combination with an uncommon golf cart. The golf dispensing apparatus of Jacobs is necessary to maintain the structural integrity of the golf cart and only holds four balls. Jacobs suffers from lack of feasibility. It is not understood how the golf balls are maintained inside of the tube with a spring urging the balls upwardly when the outlet for the balls is larger than the balls themselves. It is believed that Jacob's golf ball dispenser is inoperable and, in any event not compatible with an ordinary golf bag.

U S. Pat. No. 4,832,362 to Chen, discloses a golf ball dispenser which is spring loaded and adapted to fit in an uncommon golf bag design. Chen's design as disclosed in FIG. 6, suffers from a weak spring and an almost certain temporary opening design. For example, in column 5, lines 33 through 37, Chen states: "The spring constant of the spring 66 is carefully selected such that the weight of each additional golf ball will cause the spring 66 to compress an axial distance equal to the diameter of one golf ball B. " Thus, the spring in Chen's FIG. 6 does not compress the balls tightly against resilient clip 64. Such a spring would be hard to construct and indeed difficult to design based upon the disclosure of Chen. Additionally, the resilient metal clip 64 is bound to wear out sooner or later.

Other golf ball dispensers are known, for example, U.S. Pat. Nos.: 2,570,504; 2,590,154; 2,662,776; 2,881,925; 2,883,207; 3,164,393 and 4,852,896. All of the known golf ball dispensers suffer from peculiarity, complexity or infeasibility.

Most people play golf with conventional golf bags. There is nothing in the art which discloses a golf ball dispenser such as applicants' which can be inserted into a typical golf bag in a manner similar to the insertion of a golf club. The art needs such a golf ball dispenser which extends slightly above the ordinary bag with a readily accessible opening to both load and dispense golf balls therein.

Accordingly, it is an object of the invention to provide a golf accessory which is compatible with any typical golf bag. The golf accessory is about the length of a typical golf club and is insertable in the typical golf bag. The golf accessory extends slightly above the golf bag and enables a golfer to readily access a new golf ball whenever a "Mulligan" is available to the golfer or whenever another golf ball is needed for whatever the reason.

SUMMARY OF THE INVENTION

The present invention relates to a golf ball and golf tee dispenser. The dispenser is a long cylindrical transparent tube about 44" long and can be placed in any golf bag just as a golf club would be. The very top of the tube has a removable plastic cap. When the cap is removed it reveals a compartment for storing golf tees, which can be easily accessed through the 1¾" diameter width of the tube. The bottom of the golf tee compartment is a ¼" solid acrylic base which is preferably screwed into place through the exterior of the tube on four sides, thus creating a stop for the golf ball compartment below.

The top golf ball in the tube will always remain in the exact location when resting against the bottom section of the tee compartment. Since every golf ball when in the top position will be in the exact same position, this is the position in which each golf ball will be extracted. At this position there is a hole on each side of the tube. The front of the tube is where the ball is extracted —passing through a rubber grommet—which keeps the ball from freely coming out on its own. The hole on the back side of the tube is at least 1" in diameter and is used in the following manner: when a ball is needed, a finger is simply put into the hole on the back side of the tube, which in turn forces the top golf ball through the hole on the front of the tube which is surrounded with a rubber grommet. The ball simply falls right into one's hand. Of course, the hole on the back side can be the same as the hole on the front side. The hole where the balls are extracted are at a height just above the top of the bag, along with the tees, making access to both very simple. Thus, bending over, unzipping various compartments of a bag, searching through an assortment of golfing paraphernalia for what is actually needed is eliminated.

The tees and balls are extracted in the same location where golf clubs are removed. The elongated section of the hole where the balls are extracted forms an area in which your finger holds down a golf ball or the ball platform so you can freely load additional golf balls as needed and not have anything hindering a ball's insertion into the tube. When the last desired ball is put in place, the finger is removed and there is a plurality of golf balls held tightly in place by the bias of a helical spring.

The tube and spring are designed to hold twelve golf balls. The helical spring is engineered to compress easily as each ball is inserted into the tube and to extend to the top of the golf ball compartment when all of the balls have been extracted. It is preferred that the spring be about forty five inches in free length, have about ninety total coils with an outside diameter to the coils of about one and a half inches, be constructed from music wire having a diameter of about 0.062" and have a tension rate calulated to be about 0.08 pounds per inch. A spring with these dimensions will work well.

There is a 3" long tube or spool inside the chamber of the golf ball compartment. This tube has a bottom platform and a top platform. The top platform serves as a resting place for the bottom or last golf ball within the main tube. This is so the balls will at no time come in damaging contact with the coil spring. The bottom platform of this inner tube serves as a solid surface for the coil spring to engage, thus separating the balls from the coil spring itself. The bottom of the coil spring will sit on what is the bottom of the main tube itself, a ¼" piece of acrylic fixed to the bottom by a plastic cement which will then be covered by a plastic cap. The ¼" acrylic bottom and plastic cap will have a small hole in it for draining any water that might get inside the tube.

The tube stands freely in a golf bag just as a club does, and is transparent so you can lift it up to easily see how many tees and balls are stored at any given time. The tube could also be carried and does not necessarily have to be put in a bag.

The advantages of this invention over others is that it stands in the golf bag just as a club does, and is not something that is clipped on, which could fall into or out of the bag. This invention is not an integral part of a bag or cart which is molded into one spot leaving one unable to visualize how many balls are left in the tube. Thus, one does not have to purchase a bag or a cart just to get a ball dispenser. This invention has balls and tees right at club head level.

BRIEF DESCRIPTION OF THE DRAWINGS

While the specification concludes with claims particularly pointing out and distinctly claiming the subject matter that is regarded as forming the present invention, it is believed that the invention will be better understood from the following description accompanied by the following drawings in which:

DESCRIPTION OF THE PREFERRED EMBODIMENTS

Figure 1:
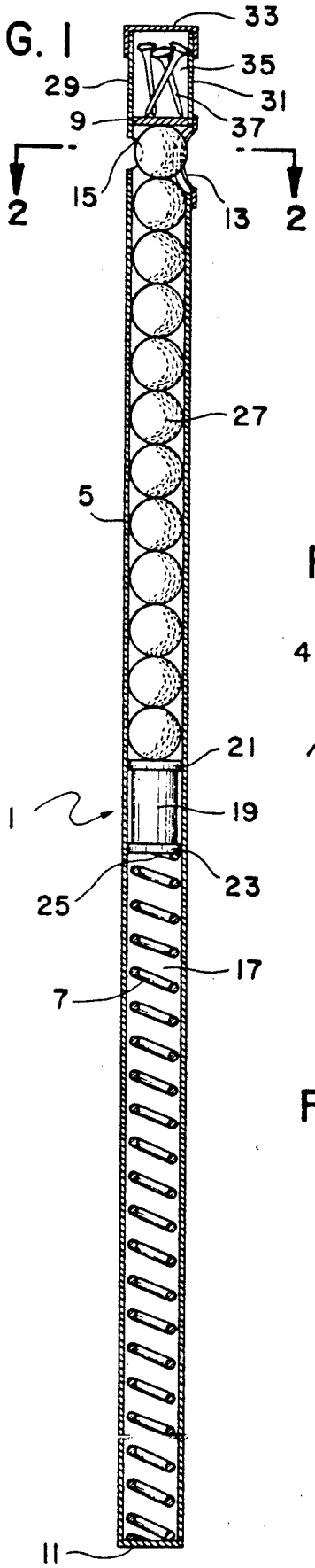
FIG. 1 is a side plan view of the golf accessory.
Figure 2:
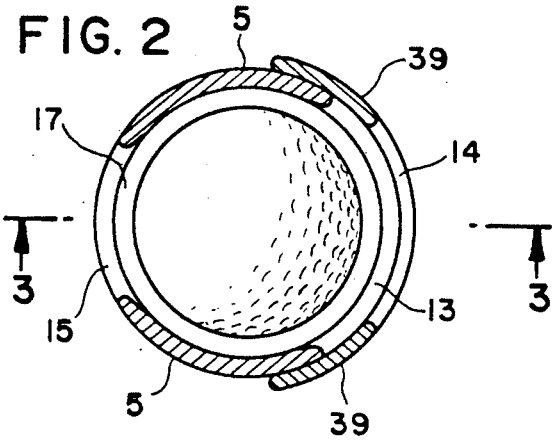
FIG. 2 is a cross secton of FIG. 1 taken at line 2—2.
Figure 3:
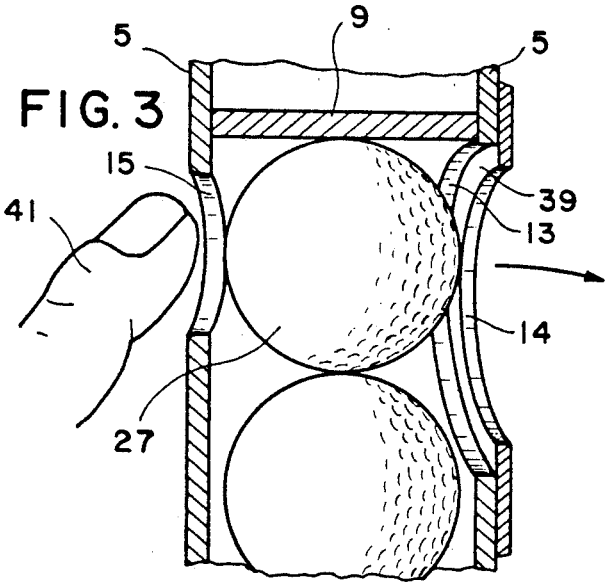
FIG. 3 is a cross section of FIG. 2 taken along line 3—3.
Figure 4:
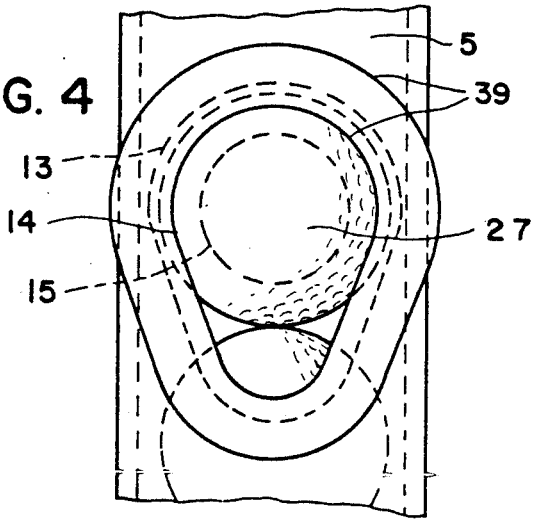
FIG. 4 is a side plan view of the best mode for the dispensing portion of the invention corresponding to points 2—2 of FIG. 1.

The best mode for practicing the invention is described in FIGS. 1 through 4. Referring to FIG. 4, the invention is generally referred to with the no. 1. The essential elements of the invention comprise the elongated hollow tube 5, helical spring 7, first closed end 9 (preferably fixed), second closed end 11 (preferably removable), first expandable opening 13 and second opposed opening 15.

Preferably the hollow tube 5 is made of a rigid transparent plastic so that one may assess the inventory of the invention.

The invention is assembled by removing element 9, which may be connected by either an interference fit, a threaded fastening or screw fixation, and inserting the helical spring 7 into the lumen or hollow 17 of the hollow tube 5. The spring 7 must be of a sufficient length to extend between ends 9 and 11. Preferably the spring has a diameter of about 1½". Preferably the bottom 11 is ¼" by 2".

Golf balls are inventoried in the invention 1 by means of expanding space between the top 25 of the helical spring 7 and the fixed top 9 of the tube 5. In other words, the spring is compressed to make room for golf balls to be loaded therein. The spring 7 then biases the golf balls 27 against the rigid top 9. Thus, the golf balls 27 are maintained near the openings 13 and 15.

A platform 19, 21 and 23 is preferred to be placed between the golf balls 27 and the spring 7. Platform 23 provides a surface for the spring to push evenly and prevents the spring from damaging the balls. Platform 21 provides a surface to support the golf balls 27 and to mate with internal surfaces of top 9. The central cylindrical section 19 is used to mutually space the golf balls from the helical spring. The disc like ends 21 and 23 preferably are ¼" by 1⅝". The barrel 19 is preferably hollow and is 1½" by 2½. When the spool 19, 21 and 23 is to be used with the invention 1, it is assembled in the same fashion as is the spring 7 inside of the hollow tube 5 except, of course, the spool shall proceed the spring when being introduced into the lumen 17. (Lumen is used to describe the hollow space within the tube 5.)

A container for tees is located at the top of the hollow tube 5. It is preferred that the top end 9 be situated some distance below the absolute top of the tube 5. Thus, a container for tees is provided. Preferably the compartment for tees 35 is 1¾" in diameter by 2½" deep. The tee container comprises sidewalls 29 and 31, bottom 9, removable top 33 and holds a plurality of tees 37.

The manner in which the golf balls are to be moved into and out of the invention 1 is shown in FIGS. 2, 3 and 4.

Referring to FIG. 2, a view is provided of the golf ball 27 situated in the lumen 17 of hollow tube 5. The ball 27 is shown nearabout the opposed holes 13 and 15.

One embodiment of the expandable opening 13 is shown. An elastomeric material 39 is shown on both sides of opening 13 and is shown to be slightly occluding the opening 13. As shown, opening 13 is greater then the diameter of the golf ball 27, yet the occluded opening 14 is shown to be less then the diameter of the golf ball 27. The golf ball 27 is removed from the lumen 17 of the hollow tube 5 by a finger or like object being inserted through hole 15 and urging the golf ball against the elastomeric or deformable material 19 to widen the opening 14 to that of opening 13, whereupon, the ball moves to the outside of the tube 5. In reverse fashion the ball is inserted into the lumen 17. Referring to FIG. 3, a finger 41 is shown juxtaposed to opening 15 to show dimensional requirements for the hole 15. The golf ball 27 is shown urged by another golf ball against top 9. The golf balls are maintained within the walls of the tube 5. The elastomeric material 39 is shown in a perspective view to slightly occlude opening 13. It is preferred the openings 13 and 14 be elongate for easy ingress and egress of the golf ball 27. Of course, opening 15, can be identical to opening 13, 14. Indeed, a plurality of such expandable openings may line the tube 5.

FIG. 4 shows a horizontal line up of the elements of the invention from the point of view of the expandable opening. On the outer most surface is the elastomeric material 39 defining expandable opening 14. This material is shown to be a gasket-like or grommet-like elastomeric material such as rubber which may be fixed in known fashion to the outside surfaces of the tube 5. An equivalent of the elastomeric material would be rathe stiff, closely aligned bristles radially lining the opening. Also, though not shown, the material 39 may be situated on both the inside and outside of the opening 13 as a sleeve. In FIG. 4, the dotted line 13 represents the rigid opening which is larger in diameter then the golf ball defined by the dotted line 27. The opposed rigid hole represented by the dotted line 15 is shown as it would be situated behind the golf ball 27.

The invention is to be used with any conventional golf bag. Therefore invention 1 is preferably about 44" long. The outer diameter of the hollow tube 5 is preferably 2" and the internal diameter of the lumen 17 is preferably 1¾. Those ordinarily skilled in the art will readily understand that the materials used to construct the invention are available in the market place. Woods, composites of plastic and fiber, laminates, various hardware described hereinabove are all suitable for use in constructing the invention.

In development of the prototype, one reviewer expressed cynicism because the invention displaced the bulk of one club. The reviewer stated he would prefer a shorter tube containing half the balls and suggested th clip of Chen (U.S. Pat. No. 4,832,362) for attaching the tube to the side of the bag. However, the reviewer admitted that the clip as shown in Chen's FIG. 6 suffered from breakage. It is self evident that even the shortened tube displaces the bulk of a club at least at the top of the bag.

The invention covers shortened versions of the tube but the reader is admonished that a clip is necessary to maintain the tube near the top of a golf bag, lest the tube be inconveniently placed beyond reach at the bottom of the bag.

As this invention may be embodied in several forms without departing from the spirit or essential characteristics thereof, the present embodiment is therefore illustrative and not restrictive, and since the scope of the invention is defined by the appended claims, all changes that fall within the metes and bounds of the claims or that form their functional as well as their conjointly cooperative equivalents are therefore intended to be embraced by those claims.

What we claim as our invention is:

1. A golf accessory apparatus, comprising:

(a) a hollow tube comprising closed first and second ends, a lumen slightly greater than the diameter of a golf ball;

(b) a first hole communicating with said lumen located at a point about a golf ball diameter from said first end and having an opening normally smaller than the diameter of a golf ball which is expandable to greater than the diameter of a golf ball;

(c) a second hole communicating with said lumen located at a point substantially opposed to said first hole and having a diameter greater than a diameter of a finger and smaller than the diameter of a golf ball, whereby one may urge with a finger a golf ball located between the holes against the opening of the first hole to expand the opening and eject the golf ball from the tube;

(d) a spring located in said lumen between said closed ends to position a golf ball against said first end between the two holes.

2. The apparatus of claim 1 wherein said hollow tube extends beyond said first end to provide a container for tees, said container having a removable cap.

3. The apparatus of claim 1 further comprising a container for tees attached to an exterior surface of said first end, said container comprising a removable cap.

4. The apparatus of claim 1 further comprising a carriage slidable within said lumen and situated between said spring and said first end to provide a platform for golf balls, a mating surface with said first end when the tube is empty and a platform for the spring to evenly urge the golf balls against the first end.

5. The apparatus of claim 4 wherein the first hole is lined with a material which is deformable.

6. The apparatus of claim 5 wherein the deformable material is an elastomer.

7. The apparatus of claim 6 wherein the first hole is ovoid in shape and wherein the elastomer lines only a portion of the ovoid shape.

8. The apparatus of claim 7 wherein the tube is round, clear and made of plastic, wherein the spring extends the length of the tube when empty, wherein at least one end is removable, and wherein the carriage is shaped like a spool with a barrel 1½" in diameter, 2½" in length and comprising top and bottom platforms ¼" thick and 1⅝" in diameter.

9. A golf accessory apparatus, comprising:

(a) a hollow tube having a lumen with a diameter slightly greater than a golf ball diameter and having first and second closed ends;

(b) first and second opposed holes near said first end each communicating with the lumen, wherein said first hole has a resilient, expandable opening ranging in size from smaller to larger than the diameter of a golf ball, to allow ingress and egress of golf balls where they are urged against the resilient and expandable opening;

(c) a compressible spring extending between said first and second closed ends to bias golf balls against said first end.

10. The apparatus of claim 9 wherein said second hole has a resilient, expandable opening ranging in size from smaller to larger than the diameter of a golf ball, to allow ingress and egress of golf balls when the balls are urged against the expandable and resilient opening.

11. The apparatus of claim 9 wherein said second hole is rigid and smaller than the diameter of a golf ball.

12. The apparatus of claim 11 wherein the first hole is elongated.

13. The apparatus of claim 12 further comprising a spool between the spring and the first closed end, said spool having a central cylindrical section and two flat end sections, wherein the spool supports the spring on one side and supports golf balls on another side and mates with surfaces of the first closed end.

14. The apparatus of claim 13, further comprising a tee compartment above said first closed end, said tee compartment having a removable cap.

15. The apparatus of claim 14, wherein the spring is helical having a diameter of about 1½ inches.

16. The apparatus of claim 15 wherein at least one end is removable to load the apparatus with golf balls and replace and repair the spool and spring.

* * * * *